United States Patent [19]
Iannarelli

[11] 4,348,845
[45] Sep. 14, 1982

[54] THERMALLY INSULATED MASONRY BLOCK

[76] Inventor: Anthony N. Iannarelli, 345 N. Washington St., Belchertown, Mass. 01007

[21] Appl. No.: 156,048

[22] Filed: Jun. 2, 1980

[51] Int. Cl.³ ..... E04B 2/00
[52] U.S. Cl. ..... 52/405; 52/309.9
[58] Field of Search ..... 52/405, 309.8, 309.9, 52/576, 577, 309.12

[56] References Cited

U.S. PATENT DOCUMENTS

| | | | |
|---|---|---|---|
| 3,204,381 | 9/1965 | Perreton | 52/405 |
| 3,318,062 | 5/1967 | Grants | 52/405 |
| 3,410,044 | 11/1968 | Moog | 52/309.8 |
| 3,546,833 | 12/1970 | Perreton | 52/405 |
| 3,632,725 | 1/1972 | Jones | 52/309.8 |
| 3,704,562 | 12/1972 | Grants | 52/405 |
| 3,885,363 | 5/1975 | Whittey | 52/405 |
| 4,027,445 | 6/1977 | Nickerson | 52/405 |
| 4,071,989 | 2/1978 | Warren | 52/405 |
| 4,073,111 | 2/1978 | Warren | 52/405 |
| 4,148,166 | 4/1979 | Toone | 52/405 |
| 4,269,013 | 5/1981 | West | 52/405 |

FOREIGN PATENT DOCUMENTS

| | | | |
|---|---|---|---|
| 2440466 | 3/1976 | Fed. Rep. of Germany | 52/405 |
| 2712152 | 10/1977 | Fed. Rep. of Germany . | |

*Primary Examiner*—Price C. Faw, Jr.
*Assistant Examiner*—Henry E. Raduazo
*Attorney, Agent, or Firm*—Ross, Ross & Flavin

[57] ABSTRACT

A two-part composite insulated masonry building block assembled as to both of its parts at the site of manufacture and transportable in assembled form to the construction site and including, as a first part, a block of concrete or other cementitious material having spaced outer and opposite side walls together with a trio of spaced transverse webs connecting between the side walls and defining a pair of equal cells or cavities, with at least two of the webs being provided with tapered air gaps or thermal breaks extending upwardly from the lower horizontal plane of the block, and as a second part, a longitudinally-extending insulative element of molded polystyrene or other suitable rigid foam material being complementarily configured with strategically-located tapered slots extending downwardly for the seating of the insulative element between and in general parallelism with the block side walls and into the tapered air gaps in interdigitating relationship and defining additionally an insulation capacity at each end of the block by virtue of an end tab at each terminus extending outwardly from one side thereof in a plane normal to the longitudinal plane for frictional embracement with the outwardly-facing surface of the adjacent block web, the insulative element being receivable within the confines of the block and with a sufficiency of space yet remaining in the cells for the conventional installation techniques inclusive of the insertion therethrough of conduits, reinforcing bars and like related equipment and/or the charge thereinto of filling material of cementitious or other characteristic.

2 Claims, 14 Drawing Figures

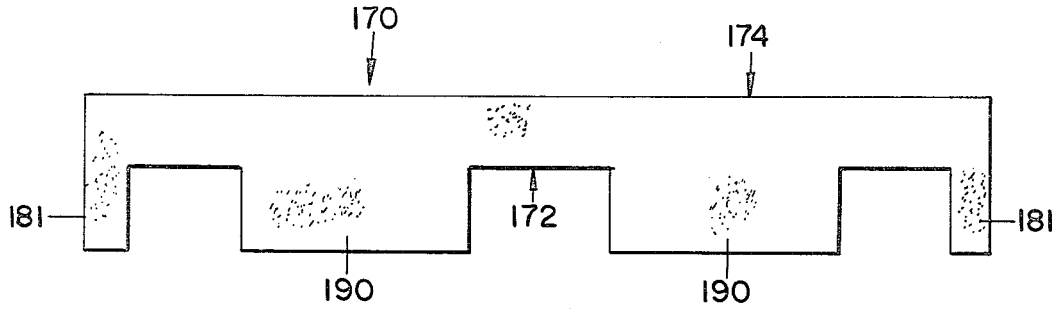
FIG. 13.
FIG. 12.
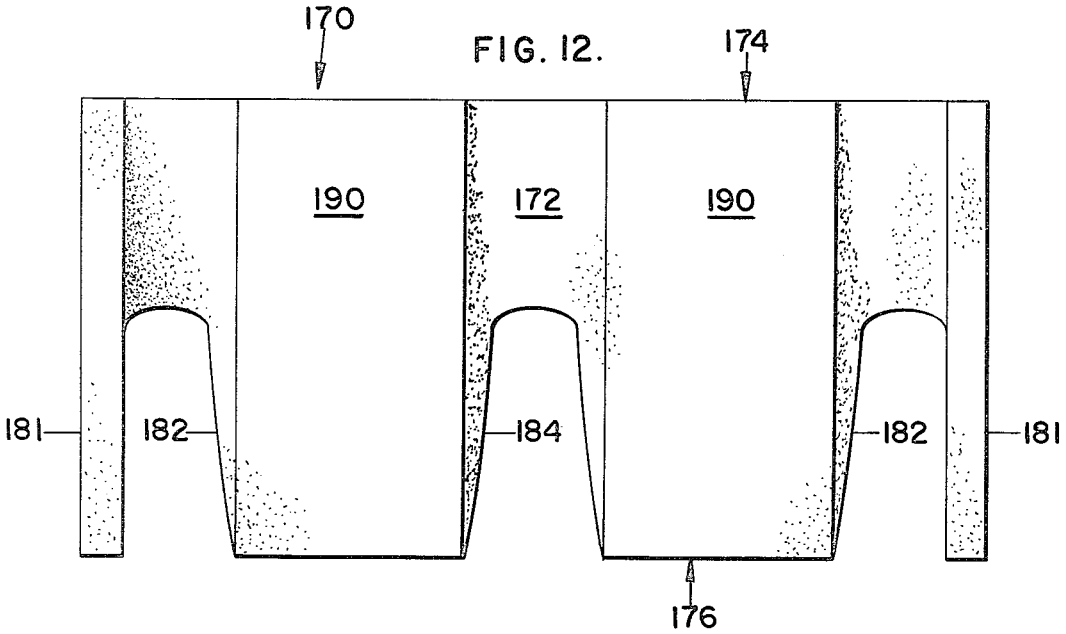
FIG. 11.
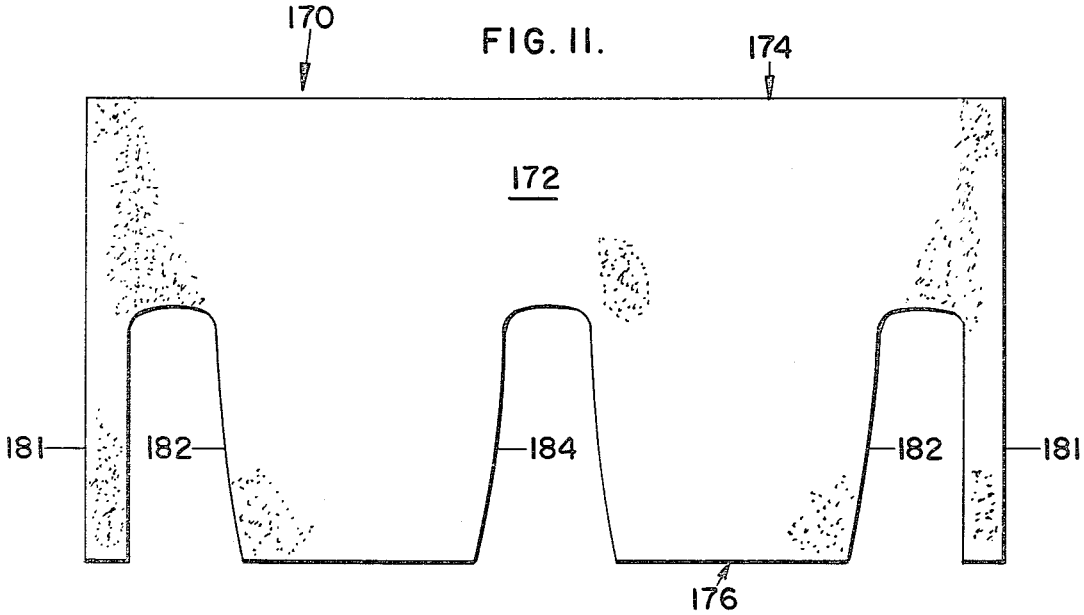

THERMALLY INSULATED MASONRY BLOCK

My invention provides an insulated masonry building block of the type which normally has two cavities and is served by a preformed insulative liner. The block normally includes transverse webs modified in manner such as substantially to reduce heat transfer thereacross.

Stated otherwise, the invention comprises a composite structure inclusive of a first component, namely a block, modified from the conventional block design to define means for best accommodating a second component, namely a thermal element strategically insertable into the block. The composite structure allows the erecting of building walls having high thermal insulation and moisture barrier characteristics, the blocks offering the unique advantage that the composite feature can be and preferentially is imparted thereto at the manufacturing site, the thermal element being combined with the block thereat, to the end that the composite blocks so assembled are then transported to the construction site where they are laid in the usual manner.

At the outset, a few remarks as to terminology are indicated. Standard specifications on face-shell and web thicknesses in hollow load bearing units of concrete blocks are already well established. The face-shell of a concrete block will be understood to be the solid portion one observes when the unit is laid up in a wall. Geometrically, a concrete masonry unit may be thought of as two face-shells which make up the inner and outer surfaces of a wall and which are held together by three or more webs which span across the wall width. Values have been found by research and experience to provide the necessary compressive strength and stiffness of design of concrete masonry.

PURPOSES OF THE INVENTION

A primary object of my invention is to provide a composite insulated building unit, including a block of lightweight concrete or other cementitious material and cooperant insulative liner received entirely within the confines of the block.

Another object is to provide an insulative element so receivable within the block confines as not to interfere with the dry stacking of lightweight concrete building block and insulate that portion of the wall at the end joints of the building block. Blocks heretofore remained uninsulated at their ends because no masonry unit had insulating end tabs as a solution for the problem.

Another ancillary object of the invention, depending from the above defined characteristic pertaining to the insulative element being so receivable so as to be entirely located within the block confines is to provide a block which may be successfully cubed or palletized for ease in handling by automated equipment.

Still another object is to provide an insulative element which will be received within the confines of the building block as not to interfere with the placement of horizontal joint reinforcement of the type that has diagonal cross rods that help resist longitudinal tensile stresses.

A further object is to provide an insulative element which will be received within the confines of the building block as not to interfere with the placement of horizontal joint reinforcement of the truss type when used in a composite wall with a brick facing.

Another object is to provide an insulative element which will make it possible to maintain cavities to allow for vertical reinforcement as required in load-bearing masonry wall construction. In the past, this part of the masonry wall normally was not insulated and accounted for as much as 30% of the wall area in a typical reinforced building remaining uninsulated when concrete grout was placed around the reinforcement rods.

Another purpose hereof is to maintain uninterrupted webs to receive mortar mix and the face shells to increase strength of reinforced grouted walls with vertical rods and horizontal wall reinforcing wire.

Another purpose hereof is to provide an insulated masonry unit useful in conjunction with epoxy adhesive mortars, now replacing the conventional mortars in masonry block construction. Such dictate use of a pre-insulated masonry unit in which the insulating element at no point protrudes beyond the confines of the building block. This type of construction lends itself to vertical end stacking and allows creation of novel load-bearing walls offering distinctive vertical shadow lines.

BACKGROUND OF THE INVENTION

The assemblage represents a significant design change in masonry units such as to help generously in meeting current demands for improved energy-efficient building components.

Present day concerns relative to energy conservation have dictated the development of improved techniques for incorporating integral thermal insulation in buildings and other structures of single wythe masonry walls.

Walls have heretofore been insulated to be sure, sometimes by applying layers of thermally insulative material to the exterior formed wall surfaces in the effort to meet the required thermal insulation standards. But these solutions have required additional protective covering adding appreciably to the construction and maintenance costs and loss of the durability of the concrete for permanence purposes.

Too, insulation in some form is sometimes introduced to the block cavities after a course thereof has been laid. In some instances, the system has envisioned the placement of insulative material in the cores or air cells between the outer and inner block walls while ignoring completely the thermal throughpaths represented in the webs of the blocks extending in planes normal to those outer and inner walls, and/or the thermal paths represented in the end areas of the blocks outboard of the outermost webs, all seriously limiting the achievable thermal insulative effects.

The standard concrete block must be understood to define two primary heat paths; those extending from the outside to the inside face shell through the outside and inside walls and through the core or cores, and those extending from the outside to the inside face shell through the outside and inside walls and through the webs connecting therebetween.

Heretofore, it has been believed necessary only to insulate the core area or areas in order to satisfy the demands of builders and owners and to meet the requirements of codes, all in the striving for thermally efficient exterior envelopes.

But those stark facts of modern life, higher fuel costs and need for energy conservation, not to mention increasingly greater stringencies in developing code requirements, all have dictated a need for new solutions in product design and thermal transmission values.

Given the general acceptance of a single wythe load-bearing masonry wall as one of the most economical approaches to appealing design of buildings, while most effectively off-setting spiraling construction costs and satisfying code specifications, this invention gives significant answer to the vexing problem of heat flow through the conventional masonry unit by the introduction of what I elect to define as an engineered air gap which creates a thermal break in the novel web of my design.

A prime consideration in the development of my design has been toward a maximizing of the block's thermally insulative quality, while yet maintaining its structural integrity through increased web thickness to provide the necessary strength and rigidity for withstanding vertical and eccentric loading and to meet fire ratings as determined by equivalent thicknesses.

Other key considerations have been in lessening significantly the thermal conductivity by interrupting to as great a degree as possible the thermally conducting through paths offered by the webs and by the retention of cavities for the normal handling and installation techniques incorporating any of the various types of horizontal and wall reinforcing wires and ties.

Another consideration has been to provide a thermally insulated masonry block requiring only a single unitary elongated insulative liner within the block confines, which liner may be installed at the manufacturing site wherefor the composite structure can be pelletized and transported to the construction site by the normal and conventional methods.

Before now, buildings have been insulated in a plurality of different ways, each system presenting problems of its own, with the generally accepted objection to the techniques so far developed being that the insulating member is usually brought to the construction site as a separate member, there to be integrated with a related building block, usually following the laying of each course of blocks as the wall structure undergoes erection. The known techniques do not lend themselves to the obviously desirable fact situation of combining block and filler, as it is sometimes called, at the situs where the block is cast and then transporting the so-modified block to the construction site whereat the mason need only lay up same according to his conventional techniques, the need for any adding filler to block after the block has been set in place, with the added labor costs represented thereby, being obviously obviated.

The systems of the prior art are exemplified in the pertinent U.S. Pat Nos. of which I am aware and include:

Parreton: 3,204,381 of Sept. 7, 1965
Grants: 3,318,062 of May 9, 1967
Moog: 3,410,044 of Nov. 12, 1968
Perreton: 3,546,833 of Dec. 15, 1970
Whittey: 3,885,363 of May 27, 1975
Nickerson: 4,027,445 of June 7, 1977
Warren: 4,071,989 of Feb. 7, 1978
Warren: 4,073,111 of Feb. 14, 1978

Many of these citations have included proposals involving the placement of a thermal insulation medium within a concrete block, as for example as exemplified in U.S. Pat. Nos. 2,199,112, 2,852,934, 3,204,381, 3,318,062, 3,546,833, and 3,885,363, but most proposals suffer from the obvious disadvantage that the preformed insulative liners have to be set in place with respect to the preformed blocks only after the blocks have been laid in situ, the procedure normally taking place following the laying of each course, when the laying of blocks momentarily stops and placement of liners ensues, an utter waste of time and money.

In some prior art instances, the system envisions the placement of insulative material in the air cells between the outer and inner block walls, all the while ignoring completely the thermal throughpaths represented in the webs of the blocks extending in planes normal to the outer and inner walls and in the end cores created when blocks are placed end-to-end, thereby seriously limiting the achievable thermal insulative effects.

In Perreton, U.S. Pat. No. 3,204,381, when and where, as he indicates, the insulating member may be provided as a strip of any desired length to be received in a plurality of blocks, it is obvious that such strip could only be added to the plurality of blocks after the blocks are set in place. While it is true that he states that the insulating member can be inserted in the block prior to laying the same in a wall, he does describe and illustrate an insert which has one side offset longitudinally and vertically for shiplapping purposes wherewith he effects an interlocking situation. Obviously, with parts of the insert extending outwardly of a side or face of the block, the combination of block and insert does not lend itself to a favorable stacking situation in the transport of the supplies to the construction site. And this is equally true of Perreton, U.S. Pat. No. 3,546,833.

Incidentally, neither Perreton block allows any extending through the cores thereof of piping or wiring or cement, once installed, and all for the obvious deleterious reason that the entirety of the core is filled with insulating material.

Many different types of insulated building blocks have bee proposed and utilized, and are exemplified in the patent literature, but with many of such, they merely provide air spaces for insulation purposes. In many other cases, where the provided air spaces are large enough to accomplish an insulating function, the load-carrying characteristics of the block have been infringed upon.

Another common difficulty with the prior art mechanisms has been that, while a barrier wall may be extended through the air space or spaces in a block, no provision is made for extending that barrier wall through the usual block webs at the sides of the air spaces.

The geometry of the block of this invention allows a mold design such that, in the forming process, the area within the mold and below the web air gaps may be filled by conventional vibration and compaction techniques at normal cycle speeds for maximum production and, without the need for additional bottom sled plates or special rakes.

Further advantageously, tests performed on conventional blocks and on the blocks hereof have disclosed comparative compressive strengths and greatly improved thermal resistance values.

BRIEF DESCRIPTION OF THE DRAWINGS

FIGS. 11, 12, and 13 are front elevational, rear elevational and top plan views respectively of a modified form of thermal insulative element of the invention.

DESCRIPTION OF THE PREFERRED EMBODIMENT

Directional and/or geometrical terms such as "top", "bottom", "side", "transverse", "horizontal", "vertical", etc. are used freely hereinbelow but it is to be understood that such terminology is employed for convenience of description only and is not to be regarded as in any way limiting the invention in the specification or the claims which follow.

Figure 1:
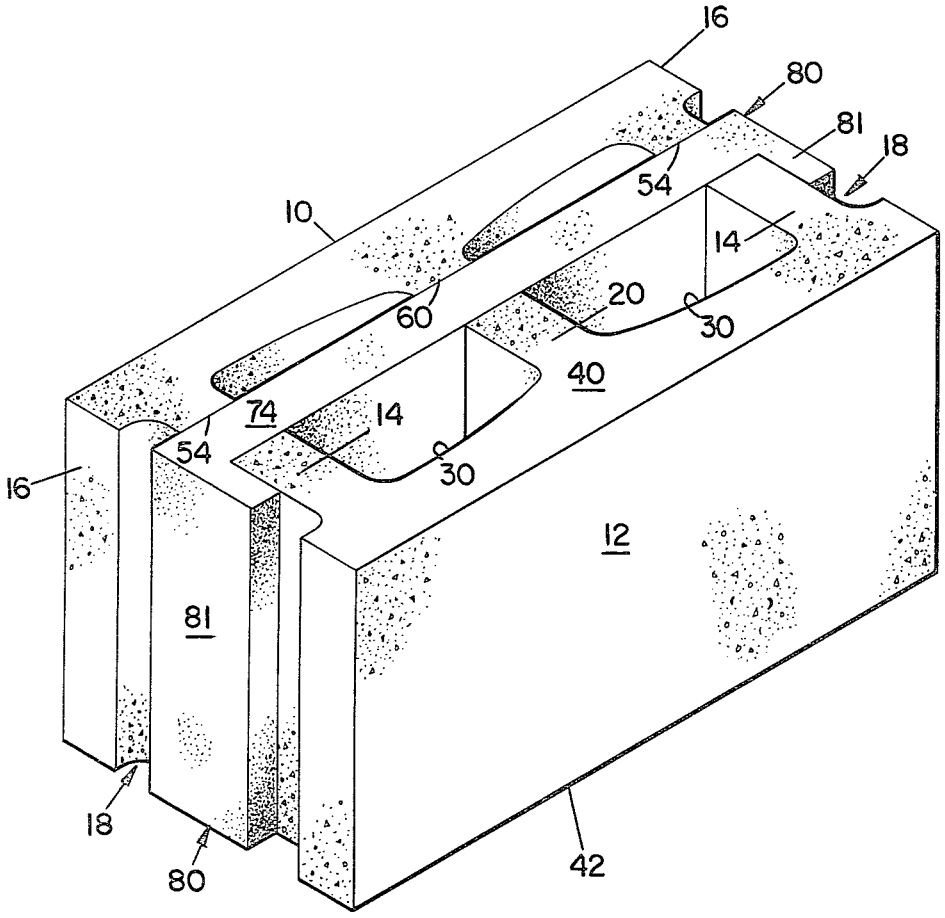
FIG. 1 is an inverted isometric view of a masonry block with the thermal insulative element inserted into operative position therewith.
Figure 2:
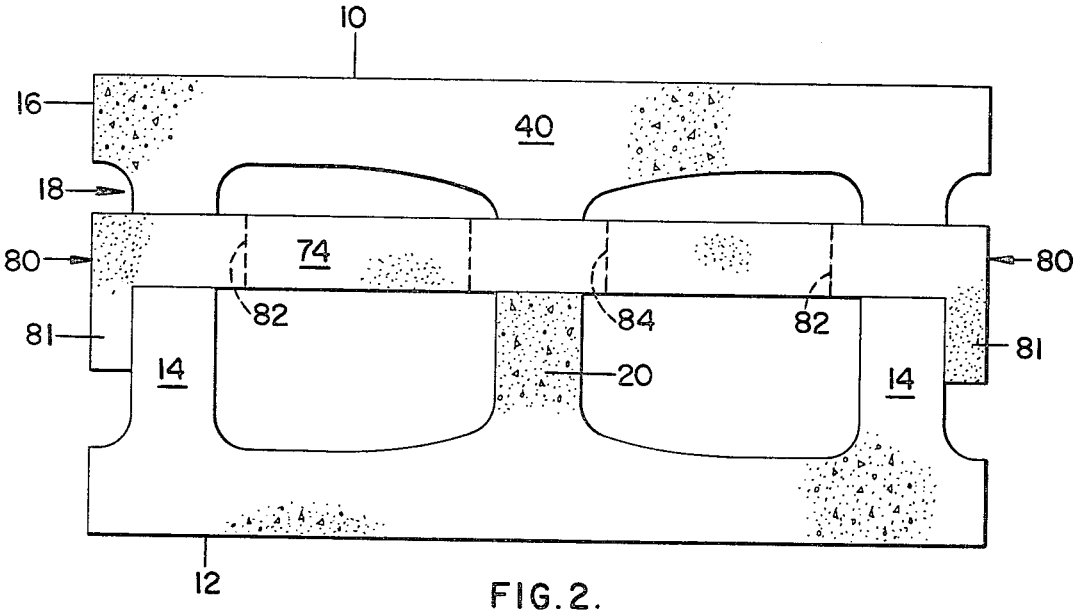
FIG. 2 is a view in bottom plan of the FIG. 1 composite block and element.
Figure 3:
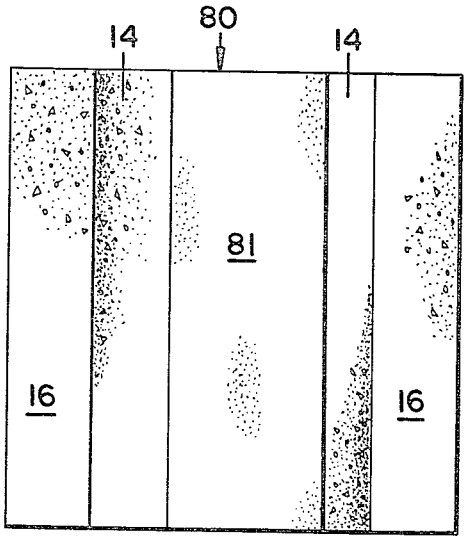
FIG. 3 is a view in end elevation of the FIG. 1 combination.
Figure 4:
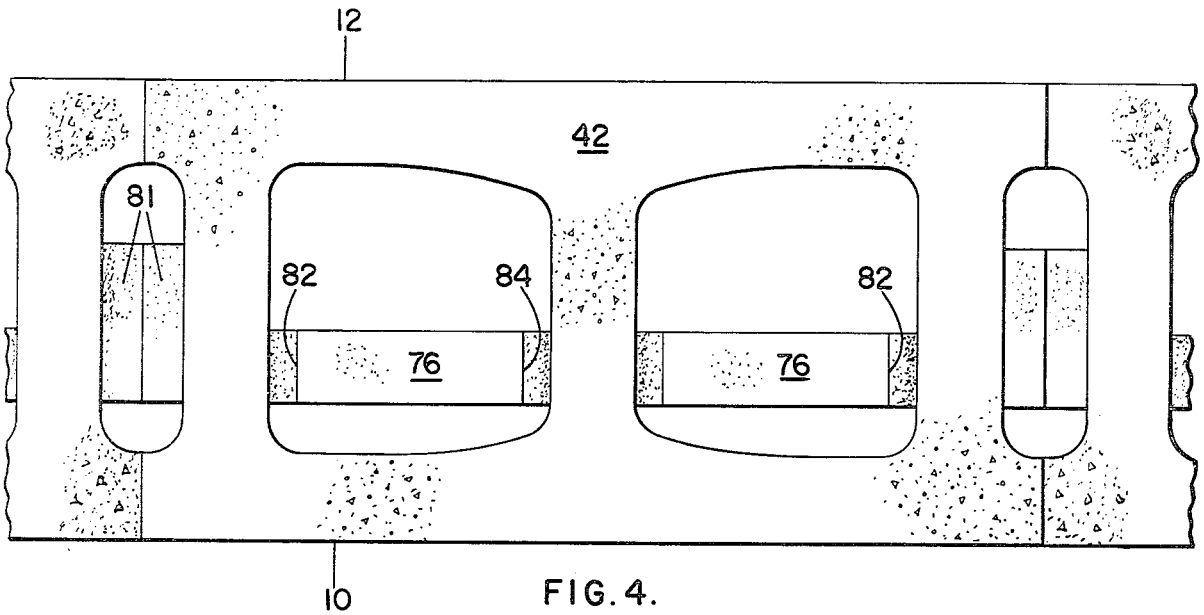
FIG. 4 is a fragmentary view in top plan of the FIG. 1 combination in cooperative association with similar blocks at opposite ends thereof.
Figure 5:
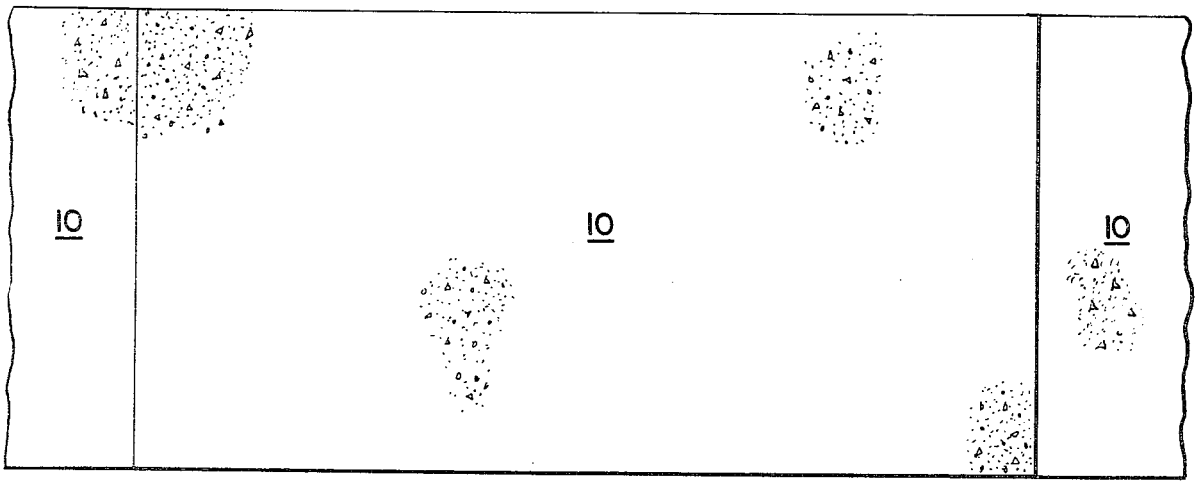
FIG. 5 is a fragmentary view in front elevation of the FIG. 4 combination.
Figure 6:
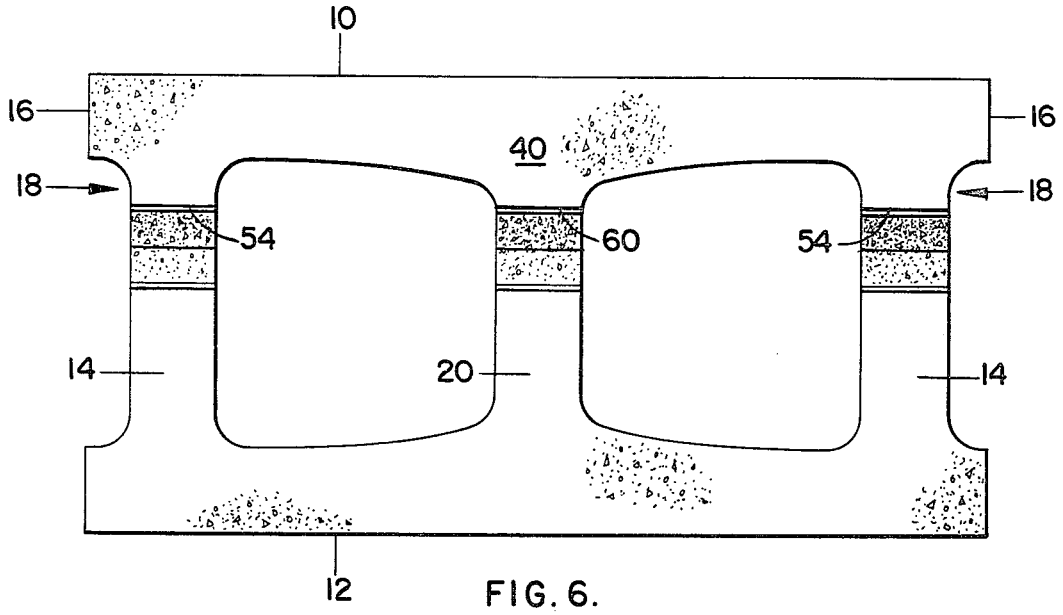
FIG. 6 is a view in bottom plan of the masonry block of the invention.

I have shown, in inverted view in FIG. 1, a building block constructed in accordance with the spirit of this invention. Same may be made of concrete or other cementitious material and is defined as being of generally rectangular blocklike configuration having a vertical exterior front face shell 10, a vertical interior rear face shell 12 spaced therefrom, vertical end webs 14, 14 adjacent opposite ends 16 but spaced inwardly from each respective end to define a vertically extending end core 18 thereat, and a vertical intermediate web 20, with end webs 14, 14 and intermediate web 20 interconnecting between the inboard sides of front and rear face shells 10 and 12, all as a unitary structure defining a pair of spaced air cells 30 each extending throughout the vertical dimension of the block from the upper planar face 42 to the lower planar face 40 thereof.

That is, air cells 30 are bounded transversely by webs 14, 20, 14 and by the integrally formed opposite parallel front and rear face shells 10, 12.

Webs 14, 14 and 20 are provided with notches or air gaps 54, 54 and 60 respectively, which air gaps extend upwardly and inwardly from the bottom plane of the block. They are disposed, not centrally of each web, but closer to the block front face 10 than to the block rear face 12 for purposes to appear. The air gaps are coplanar in the sense that their vertical dispositions are in alignment with each other and in parallelism with the plane of the block front face.

Figure 7:
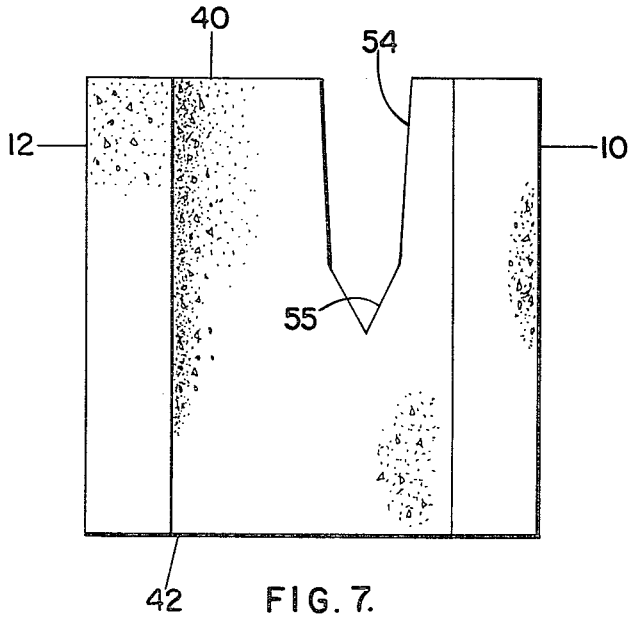
FIG. 7 is a view in end elevation of the FIG. 6 block.

As best observed in FIG. 7, the air gaps extend upwardly from the bottom 40 preferentially for a distance equal to approximately one half the block height.

The configurations and dimensions of the air gaps provided in the transverse webs may vary within the scope hereof provided they represent in all instances a judicious compromise between maintenance of a top to bottom compressive strength of the block and insulating efficiency.

Figure 10:
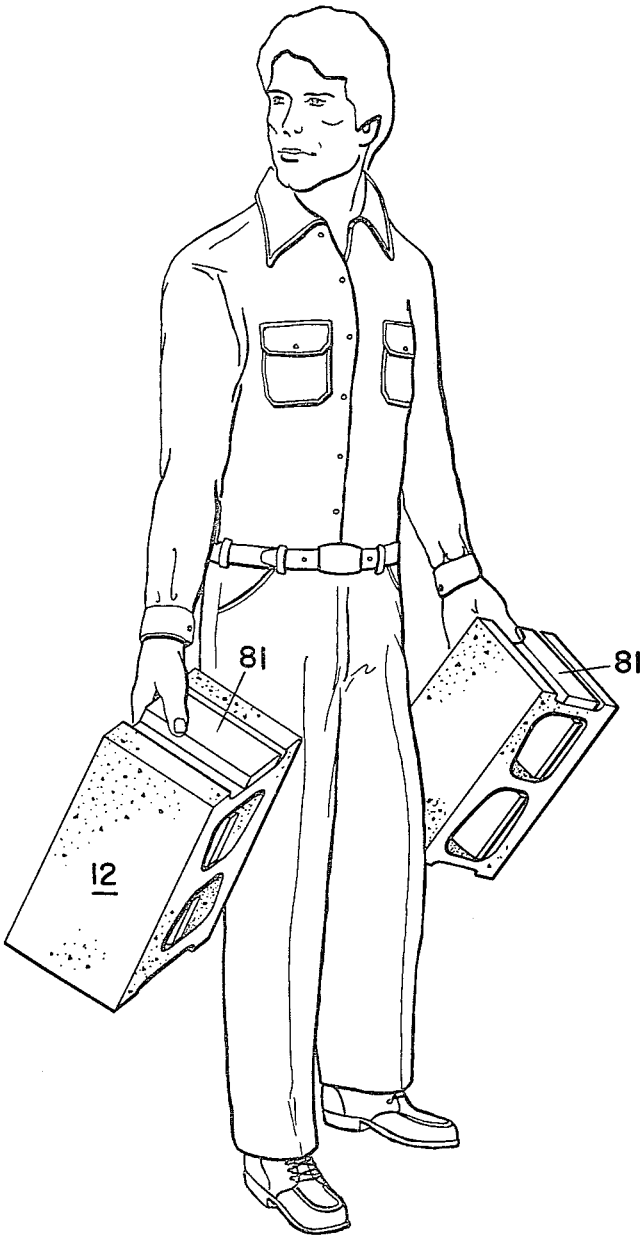
FIG. 10 is a view showing a mason carrying two of the composite blocks of the invention from the manufacturing or storage site to the construction site.

The block is preformed in a conventional manner, and as shown in FIG. 10, can be readily lifted and manipulated by a workman at the manufacturing situs and at the construction site, the workman grasping one of the webs, finger access into a cavity being readily permitted.

The block may be handled from either attitude, above or below, depending on whether the handling is being carried on at the manufacturing or the construction site.

The air cells or cavities will taper gradually inwardly and upwardly so that during block manufacture, as the cores employed in molding the block may vary somewhat in dimension, especially as wear ensues through continued use. The result may be that the cross sectional configurations and/or dimensions of the cavities will be subject to variation over a modest range, the variations possibly occurring from block to block, or even from cavity to cavity in a single block.

The insulative liner or element now to be described is of such configurations and dimensions as to accommodate to these variations.

Figure 8:
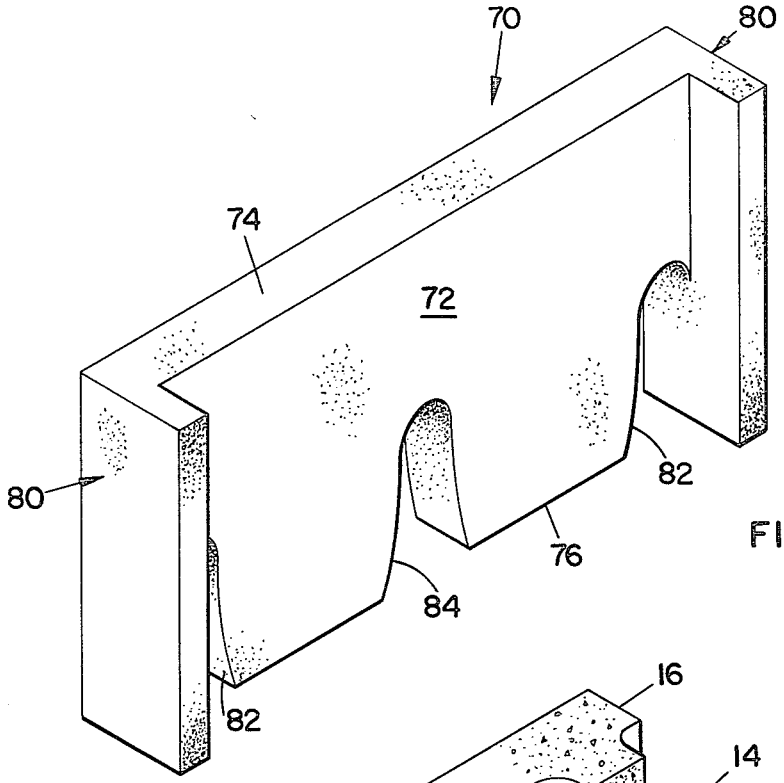
FIG. 8 is an inverted isometric view of the thermal insulative element of the invention.
Figure 9:
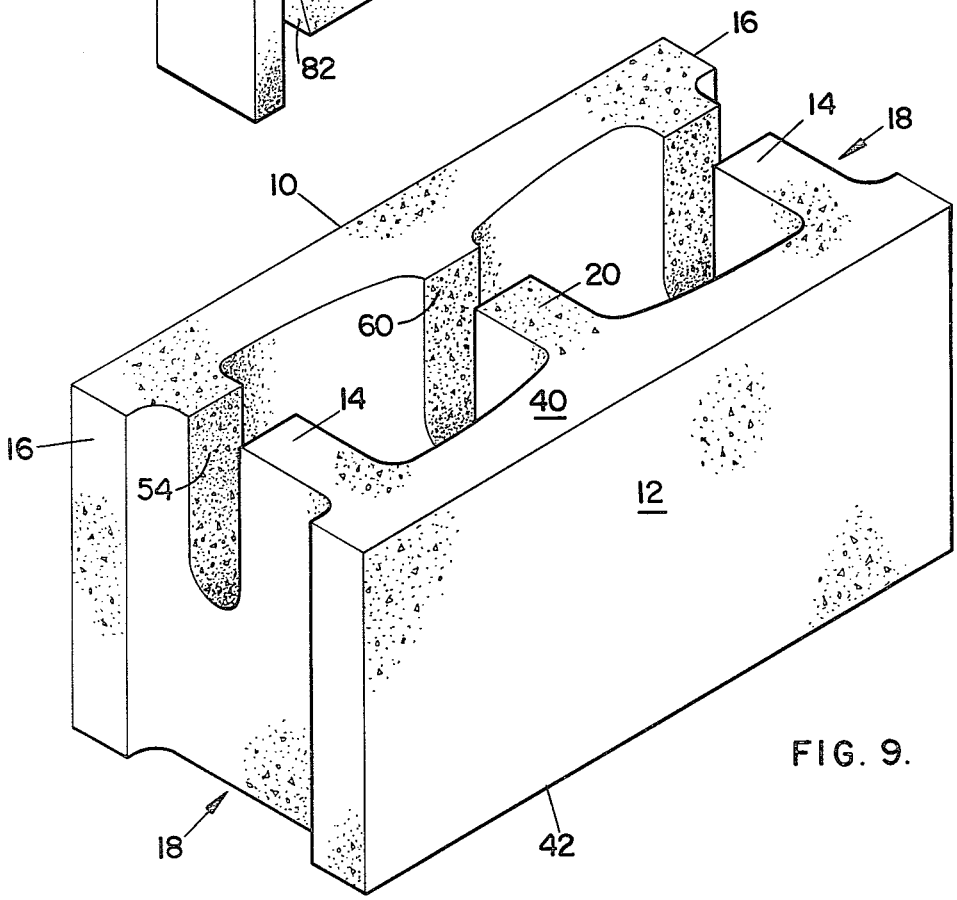
FIG. 9 is an inverted isometric view of the block.

Having particular reference to FIG. 8, there is shown an insulative element or liner 76 for use with the building block of the invention and preferentially formed of a lightweight foraminous heat insulating and fire retardant material whereby a fire stop function and a reasonable degree of resistance to sound and moisture transmission are provided. Molded expanded polystyrene has been found to be a particularly desirable material for the purpose.

It has a generally elongated configuration to define a vertically-extending wall 72 extending upwardly from a flat horizontally-extending bottom wall 74 and terminating in a flat horizontally-extending top wall 76. At the opposite ends 80 of the liner, vertically-extending end tabs 81 project rearwardly, each in a plane normal to the main longitudinal axis of the liner and throughout the insert height.

At each opposite end of top wall 76, an inwardly-extending notch 82 is provided, which notch extends inwardly approximately one half of the liner height. An intermediate notch 84 extends inwardly from top wall 76, and extends inwardly approximately the same distance.

As shown in FIG. 7, air gaps 54, 54, 60 may be each provided with a slight inward taper from the block bottom 40 and with a peaked pointed inner end wall such as shown at 55 to facilitate core bar removal without the danger of developing cracks in the air gap walls due to the inherent suction forces during block manufacture, as well as to allow for a slight clearance so that minute amounts of material may collect without interference with the placement of the liner.

The insulative elements are preformed in a configuration so as to be receivable across the cavities and within the air gaps of a block and air possessive of a degree of cross sectional compressibility so that when an element is introduced to its nesting position within a block it is allowed to accommodate to any slight variations of dimension if and as encountered and to adopt a firm engagement with the cavity and air gap walls by means of a frictional retention so as to insure against accidental displacement during handling.

I presently prefer the provision of an air gap which will have a depth or height approximately three times the thickness of the web out of which it is formed.

Thus where a web thickness of approximately 1 1/16 inch may be provided, as is conventional in many building block designs, an air gap depth of approximately $3\frac{5}{8}$ inches is provided for.

By limiting the air gap to a width and depth or height less than the midlength and by the retention of the normal cavity widths we minimize if not eliminate the dependence on wire reinforcement to retain the tensile strength.

In FIGS. 11, 12 and 13 are shown front elevational, rear elevational and top plan views respectively of a modified form of thermal insulative element of the invention.

The insulative element 170 here again has a generally elongated configuration to define a vertically-extending wall 172 extending upwardly from a flat horizontally-extending bottom wall 174 and terminating in a flat horizontally-extending top wall 176. At the opposite ends of the element, vertically extending end tabs 181 project rearwardly each in a plane normal to the main longitudinal axis of the element and throughout its height.

At each opposite end of top wall 176, an inwardly extending notch 182 is provided, which notch extends inwardly approximately one half of the insert height. An intermediate notch 184 extends inwardly from top wall 176, and extends inwardly approximately the same distance.

Between the adjacent notches and extending throughout the vertical height of the element from top to bottom is an enlargement 190 which extends outwardly from the vertical plane of the inside face of the element to a vertical plane which is coplanar with the outboard end faces of the end tabs 181. These serve the function of partially filling the respective air cells when in operative relationship with a block.

Figure 14:
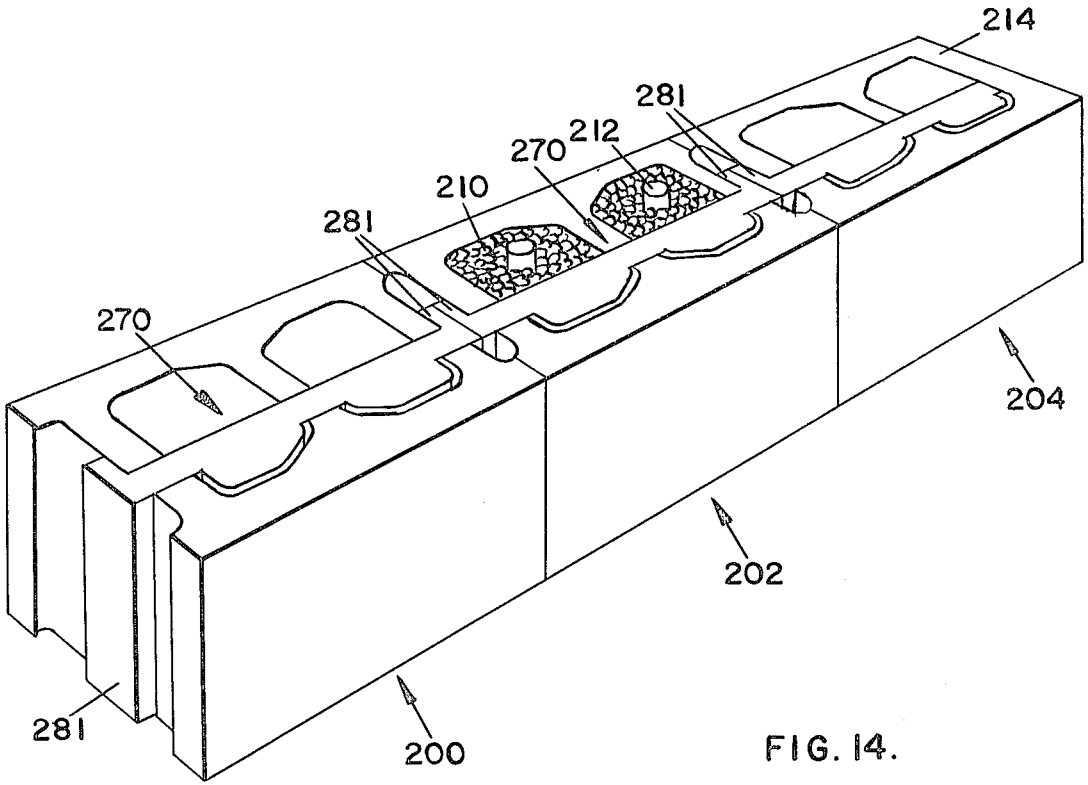
FIG. 14 is a view in perspective of two inverted conventional blocks modified so as to nestably receive another alternate form of insulative element and an inverted end block likewise modified so as to nestably receive the alternate form of insulative block adapted for an end block.

In FIG. 14, I have shown a pair of blocks 200 and 202 disposed in end to end relation with an end or corner block 204 likewise disposed in end to end relation with block 202.

Blocks 200 and 202 are each provided with an insulative element 270 having the vertically extending end tabs 281 projecting rearwardly in planes normal to the main longitudinal axis of the respective element. It will be observed that adjacent end tabs are in confronting relation with each other.

Forwardly of the main longitudinal axis of each element and throughout its height are a pair of enlargements 290 are provided which extend outwardly from the vertical plane of the inside face of the element and each have a curved outboard face of a configuration which generally conforms to the adjacent wall of the respective air cell so as to be slightly spaced therefrom and to define a moisture barrier therebetween.

Rearwardly of the element the air cells may be left unfilled as in the case of block 200 or filled with grout 210 and conceivably reinforcing rods 212 as in the case of block 202.

End block 204 may be modified so as to provide air gaps in only the inboard webs, the outboard webs 214 remaining uncut.

I claim:

1. A two-part composite insulated building block the parts of which may be assembled into a unitary configuration at the construction site or elsewhere and comprising: a first part in the form of a component of cementitious material of generally rectangular configuration and extending from a lower horizontal plane to an upper horizontal plane and further extending between opposite end planes and first having spaced outer and opposite side walls extending vertically between the said horizontal planes, a transverse central web interconnecting the said side walls centrally thereof and a pair of transverse end webs interconnecting the said side walls outboard of the central web and inboard of each respective end plane with the adjacent webs defining therebetween a of open ended air cells extending between the upper and lower planes, the webs each being provided with a tapered thermal break extending upwardly from the said lower plane to substantially midway of the vertical web height and in alignment with each other transversely from end to end of the first component, and a second part in the form of a component of rigid insulative foam extending along a longitudinal plane and configured with spaced strategically-located tapered notches extending downwardly through substantially half of its extent for the seating of the second component between and in general parallelism with the side walls of the first component and into the respective tapered thermal breaks in interdigitating relationship, the second component being further provided with an end tab at each terminus extending in a plane normal to the longitudinal plane for embracement with the adjacent end web, the second component being nestably receivable entirely within the area defined by the outermost dimensions of the first component.

2. In the building block of claim 1, with the second component being receivable within the confines of the first component with a sufficiency of space yet remaining in the air cells for the insertion therethrough of conduits and reinforcing bars and like related equipment and/or the charge thereinto of cementitious material.

* * * * *